US006644193B2

(12) United States Patent
Elsner

(10) Patent No.: US 6,644,193 B2
(45) Date of Patent: Nov. 11, 2003

(54) WEB CUTTING TUCK FOLDING MACHINE AND METHOD

(75) Inventor: Bertram F. Elsner, Hanover, PA (US)

(73) Assignee: Elsner Engineering Works, Inc., Hanover, PA (US)

( * ) Notice: Subject to any disclaimer, the term of this patent is extended or adjusted under 35 U.S.C. 154(b) by 0 days.

(21) Appl. No.: 10/095,611

(22) Filed: Mar. 12, 2002

(65) Prior Publication Data

US 2003/0172821 A1 Sep. 18, 2003

(51) Int. Cl.[7] ..... B41F 13/56; B41F 13/58

(52) U.S. Cl. ..... 101/483; 270/5.02; 270/20.1; 270/21.1; 493/359; 101/227

(58) Field of Search ..... 101/227, 226, 101/232; 270/5.02, 20.1, 21.1; 493/359, 361, 363, 365, 71, 196, 227, 287, 432; 83/155.1, 176, 424, 343

(56) References Cited

U.S. PATENT DOCUMENTS

| | | | | | |
|---|---|---|---|---|---|
| 1,185,088 | A | | 5/1916 | Goss et al. | |
| 1,331,727 | A | | 2/1920 | Seymour | |
| 2,079,651 | A | | 5/1937 | Crafts | 164/68 |
| 2,128,167 | A | | 8/1938 | Schmidt et al. | 240/71 |
| 2,306,248 | A | | 12/1942 | Zuckerman et al. | 270/6 |
| 2,659,437 | A | | 11/1953 | Huck | 164/67 |
| 3,231,261 | A | | 1/1966 | Huffman | 270/4 |
| 3,483,780 | A | | 12/1969 | Hudson | 83/81 |
| 3,758,102 | A | | 9/1973 | Munn et al. | 270/69 |
| 4,113,243 | A | | 9/1978 | Gregoire et al. | 270/21 |
| 4,368,879 | A | | 1/1983 | Hoshi | 270/6 |
| 4,432,746 | A | | 2/1984 | DeHaan | 493/359 |
| 4,490,132 | A | | 12/1984 | Ogura et al. | 493/424 |
| 4,559,032 | A | | 12/1985 | Fischer | 493/432 |
| 4,607,473 | A | * | 8/1986 | Ehler et al. | 53/54 |
| 4,709,130 | A | | 11/1987 | Lodetti et al. | 219/69 W |
| 4,822,328 | A | | 4/1989 | Bertolini et al. | 493/425 |
| 5,030,193 | A | * | 7/1991 | Breton | 493/458 |
| 5,078,374 | A | | 1/1992 | Odeau | 270/49 |
| 5,102,111 | A | * | 4/1992 | Reponty | 270/12 |
| 5,103,703 | A | | 4/1992 | Littleton | 83/155 |
| 5,230,268 | A | | 7/1993 | Richter | 83/303 |
| 5,249,493 | A | | 10/1993 | Breton | 83/154 |
| 5,429,578 | A | | 7/1995 | Calbrix et al. | 493/359 |
| 5,494,270 | A | | 2/1996 | Laubscher | 270/49 |
| 5,749,567 | A | * | 5/1998 | DeAngelis | 270/20.1 |
| 5,839,365 | A | * | 11/1998 | Calbrix et al. | 101/227 |
| 5,846,177 | A | | 12/1998 | Mayr | 493/424 |
| 5,865,082 | A | | 2/1999 | Cote et al. | 83/155 |
| 5,921,906 | A | | 7/1999 | Nagano | 493/353 |
| 5,967,011 | A | | 10/1999 | Feldkamper et al. | 83/343 |
| 6,019,714 | A | | 2/2000 | Stab | 493/429 |
| 6,038,974 | A | | 3/2000 | Richards | 101/232 |
| 6,067,883 | A | | 5/2000 | Cote et al. | 83/23 |
| 6,093,139 | A | | 7/2000 | Belanger | 493/353 |
| 6,170,371 | B1 | | 1/2001 | Cote et al. | 83/155 |
| 6,269,720 | B1 | | 8/2001 | Pelagatti | 83/343 |
| 6,279,890 | B1 | * | 8/2001 | Tomczak | 101/227 |

OTHER PUBLICATIONS

Drawing of Figure 1, Web Cutting Device 1988.
Drawing of Figure 2, Web Cutting Device 1988.

* cited by examiner

*Primary Examiner*—Eugene H. Eickholt
(74) *Attorney, Agent, or Firm*—Hooker & Habib, P.C.

(57) ABSTRACT

A high speed web cutting and tuck folding machine feeds webs downstream between overlying and underlying runs of feed belts having cutting and tuck folding openings spaced along the belts. Lead segments of the webs are cut at a cutting station and are fed downstream to a tuck fold station where they are drawn through tuck fold openings, folded and stacked. The machine is readily adjusted to vary the length of the cut segments and the relative lengths of the legs of the segments when folded.

47 Claims, 6 Drawing Sheets

WEB CUTTING TUCK FOLDING MACHINE AND METHOD

FIELD OF THE INVENTION

The invention relates to machines for cutting a continuous web into segments, tuck folding the segments and placing the folded segments on top of each other to form a stack, and to related methods.

DESCRIPTION OF THE PRIOR ART

Machines that sever webs, tuck fold the webs to form folded segments with overlying legs and then stack the segments are well known. However, in these machines it is difficult to change the machines to manufacture a different product. For instance, when a conventional machine is set up to cut, fold and stack web segments having equal length legs it is difficult and time consuming to change over the machine to make folded segments which are shorter or longer or have different length legs to either side of the fold. Further, conventional machines are unable to cut, fold and stack web segments sufficiently rapidly to meet modern production requirements.

Accordingly, there is a need for an improved machine and method for cutting, tuck folding and stacking web segments at a high production rate with great reliability. Because of the high production rate, the web segments should be held and positively controlled throughout feeding, cutting, folding and stacking to prevent jams. Additionally, the machine should be easily adjustable to change the product configuration without the necessity of assembly and disassembly or significant down time.

SUMMARY OF THE INVENTION

The invention is an improved high speed cut, tuck fold and stacking machine for very rapidly forming stacks of U-folded web segments having a desired count and related methods. The webs and the segments severed from the webs are positively held through the cutting, folding and stacking steps to reduce jams. The machine operates continuously and rapidly to meet modern production requirements yet is easily adjustable to change the configuration of the folded segments being stacked. The total length of the segments may be adjusted and the relative lengths of the segment legs may be adjusted.

The machine has a plurality of web blade lanes, permitting simultaneous cutting, folding and stacking of plural webs and may have a per lane output as high as 600 folded segments per minute and a total production of 2,400 segments per minute. The webs may be fed to the machine at a high speed of about 350 feet per minute. The stacked segments are automatically delivered to an output conveyor for transport away from the machine. The number of segments in each stack is readily adjustable.

Other objects and features of the invention will become apparent as the description proceeds, especially when taken in conjunction with the accompanying drawings illustrating the invention, of which there are six sheets of one embodiment.

DESCRIPTION OF THE PREFERRED EMBODIMENT

Figure 2:
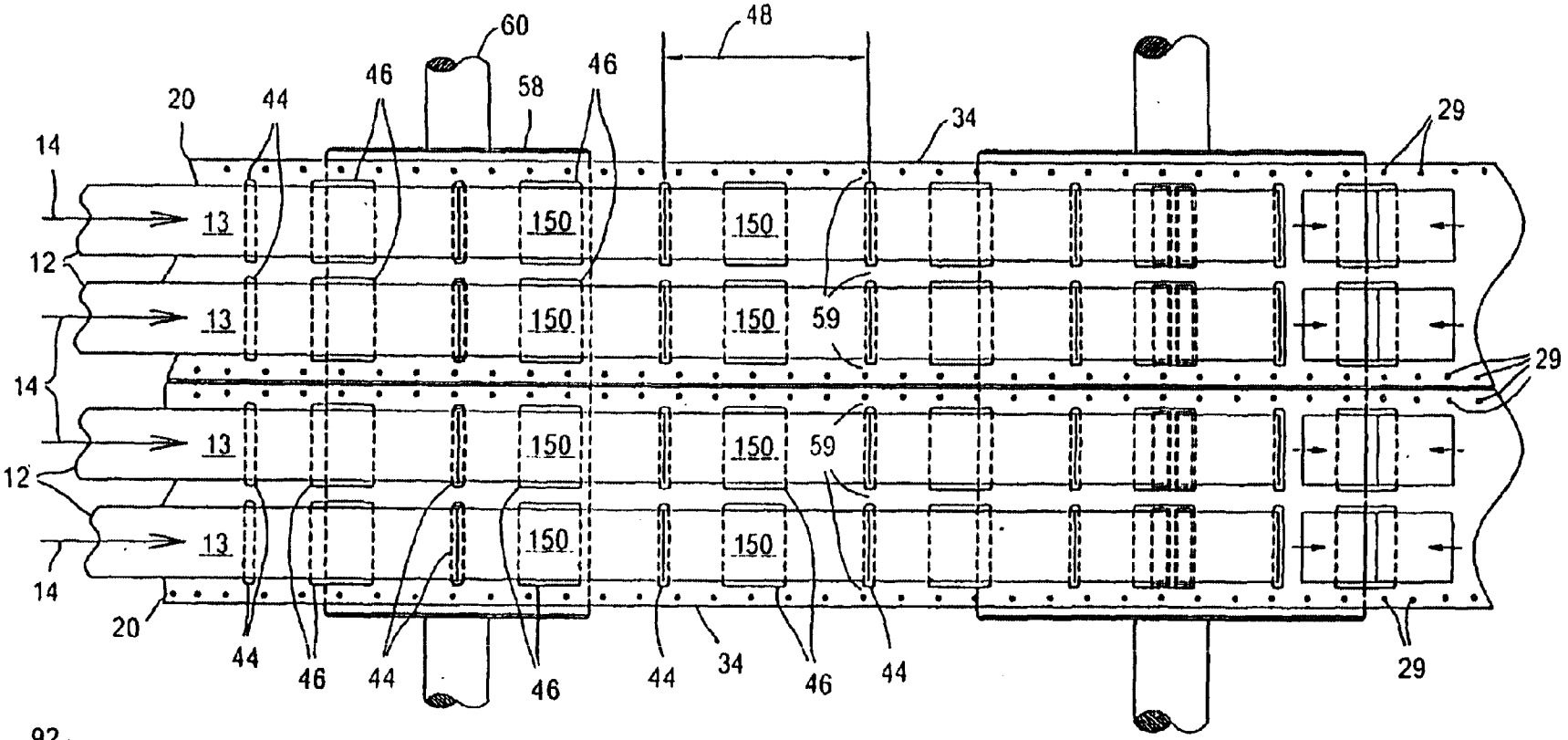
FIG. 2 is a sectional view taken generally along line 2—2 of FIG. 1.
Figure 2A:
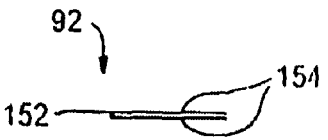
FIG. 2A is a side view of a web segment folded per FIG. 2.

Cutoff and tuck folding machine 10 receives four continuous webs 12 from web sources, cuts each web into web segments, tuck folds the individual segments to form folded segments and then places a desired number of folded segments in four stacks for discharge on a takeaway conveyor. As shown in FIG. 2, four lanes 13 are spaced laterally across one end of machine 10. The webs are fed downstream to the lanes in the direction of arrows 14 by web feed rollers 16. Rollers 16 are driven by an appropriate drive at a desired adjustable fixed speed. The rate at which the webs are fed into the machine can be adjusted. The individual webs 12 may be formed from single thickness web stock or may be pre-folded longitudinally in a W, N, or M fold or other folded configuration to permit unfolding of individual segments cut from the web by a user. The webs may be formed of any suitable material including fluffy, soft, hard or stiff materials that may be wet or dry. The folded web segments formed by machine 10 may be wipes.

The four webs 12 are fed from feed rollers 16 between two pairs of upper and lower endless feed belts 18 and 20. Belts 18 and 20 are preferably formed from flexible stainless steel bands with cutout openings and holes as described. Belts 18 are wound around upstream and downstream guide rolls 22 and 24. Belts 20 are wound around upstream and downstream guide rolls 2 6 and 2 8. Belts 18 are also wound around two upper guide rolls (not illustrated) and belts 20 are wound around two lower guide rolls (not illustrated). The shafts for all the guide rolls are journaled in bearings on the frame of machine 10. Spaced pinholes 29 are provided at the lateral edges of belts 18 and 20 and engage radial pins extending outwardly from the guide rolls to orient and drive the belts. Machine 10 includes a belt drive (not illustrated) for moving belts 18 down to roller 22, along a straight horizontal run 30 to roller 24 and up from roller 24 as indicated by arrows 32. The belt drive for belts 20 (not illustrated) likewise moves the belts 20 up to roller 26, along a straight horizontal run 34 to roller 28 and then down away from roll 28 as indicated by arrows 36. The two belts are fed at the same speed. Runs 30 and 34 extend downstream in the direction of arrow 38. The belts in two runs overlap and engage each other and are held together against sag or displacement by suitable rollers or guides located above and below the runs (not illustrated) to assure that the runs contact and feed the webs and severed web segments. The belts move past the webs when the webs are restrained by web feed rolls 16. Feed rollers 16 may feed webs 12 between the overlying belt runs 30 and 34 at the same downstream speed as the belts or at a reduced speed, as described below.

Belts 18 and 20 are alike and each includes a series of cut openings 44 and tuck fold openings 46 spaced along the length of the belt. A set of cut and tuck fold openings is provided for each lane 13. In each lane a web 12 is sandwiched between the upstream ends of belt runs 30 and 34 with the openings in the two belts are located above each other or overlying each other to form openings extending through the two runs with webs 12 extending across the openings. The cut and tuck fold openings extend laterally across the belts a distance slightly greater than the width of the webs 12. The spacing 48 between the centers of adjacent cut openings determines the maximum length of segments cut from the lead ends of webs 12 and may be seven inches.

Straight belt runs 30 and 34 extend from rolls 22 and 26 through web cutter 50 and tuck folder 52. The tuck folder delivers folded web segments to stacking and take away assembly 54 located below runs 30 and 34. Cutter 50 cuts all four webs, folder 52 tuck folds all four cut web segments and assembly 54 stacks the folded segments from the four webs.

The cutter includes a cut roll 56 located above runs 30 and 34 and an anvil roll 58 located below the runs. Rolls 56 and 58 are supported on shafts 60 and 62 journaled in bearings on the frame of machine 10. Four cutter blades 64 are arranged at 90 degree spacing around the cutter roll 56 above each of the webs 12 sandwiched between runs 30 and 32. Four anvils 66 are 90 degree spaced around the anvil roll 58 below runs 30 and 34 and roll 56. The machine 10 includes a drive to rotate rolls 56 and 58 in the directions of arrows 68 in phase with the drives for belts 18 and 20 so that each blade 64 is rotated down to the six o'clock position in the direction of movement of runs 30 and 34, extends through aligned cut openings 44 in the upper and lower belt runs 30 and 34 to cut the web captured between the belt runs against an anvil 66. The cutters have a length equal to or slightly greater than the width of the sandwiched web.

The rolls 56 and 58 carry sets of cut blades 64 and anvils 66 for each of the four webs. As illustrated in FIG. 2, the cut openings 44 for the four webs are located at the same positions across the upper and lower runs of the two upper and lower feed belts 18 and 20 with portions 59 of the belts extending across the openings. Four knives 64 are located at each 90 degree position around roll 56, one knife for cutting each of four webs 12. The knives at each of the 90 degree positions are spaced apart along the length of roll 56 so that the knives do not engage portions 59 of belts 18 and 20 between openings 44.

The tuck folder 52 includes a tuck roll 70 located above runs 30 and 34 and a gripper roll 72 located below the runs and roll 70. Rolls 70 and 72 are mounted on shafts 74 and 76 journaled bearings on the frame of machine 10. Roll 70 carries six circumferentially spaced tuck blades 80 for each lane. The blades at each circumferential location on the roll are spaced longitudinally along the roll. The roll is rotated in the direction of arrow 78 to position each tucker blade in a tuck fold opening 46 formed in the runs 30 and 34 extending between rolls 70 and 72. The rolls 70 and 72 are rotated at a circumferential speed equal to the downstream speed of belts 18 and 20. The blades push a U-shaped portion of the web extending across the tuck fold opening 46 down and between open grippers in roll 72, as described below.

Figure 3:
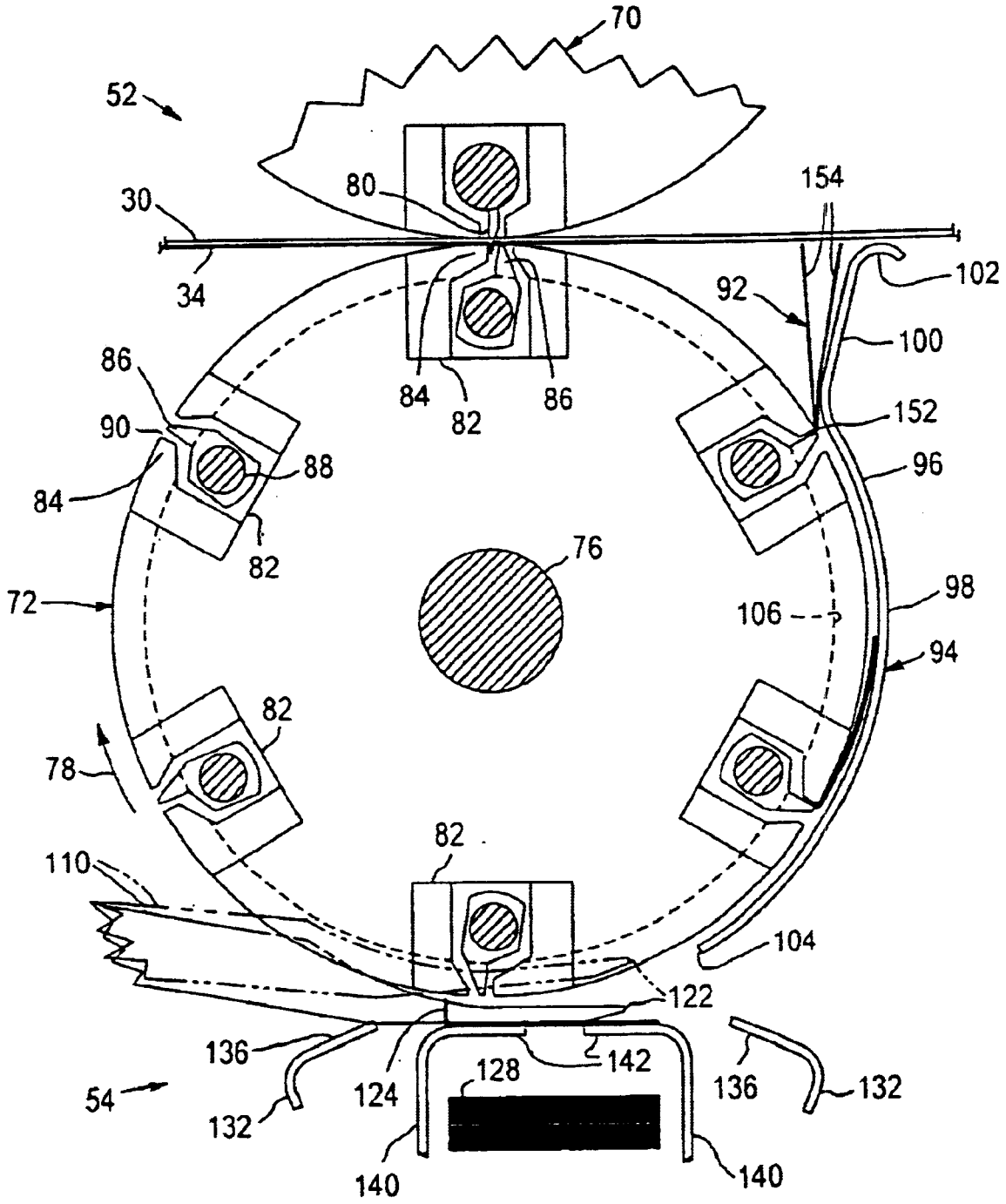
FIG. 3 is an enlarged view of a portion of FIG. 1.

Roll 72 includes six circumferentially spaced web segment grippers 82 for each of the four lanes 13. As shown in FIG. 3, each gripper 82 includes a fixed member 84 and a moveable clamp arm 86 mounted on a shaft 88. The roll 72 includes a drive for rotating shafts 88 to move arms 86 away from clamp members 84 to create gaps 90 between the arms and members and to move the arms against the clamp members to engage U-portions of the web segments tucked into the gaps 90 by blades 80.

The drives for rolls 70 and 72 rotate the rolls to position a blade 80 and gripper 82 above and below the runs 30 and 34 and a web segment held between the runs at tuck fold openings 46 in the two runs as illustrated in FIG. 2. Each blade 80 tucks a portion of the held segment down into an open gap 90. Immediately after the portion of the segment is tucked into the gap the gripper drive moves the arm 86 against fixed clamp member 84 to clamp the folded portion of the severed web segment. With continued downstream movement of the runs 30 and 34 and rotation of rolls 70 and 72, blade 80 is withdrawn leaving the segment clamped in gripper 82.

Further rotation of roll 72 pulls the gripped web segment down through the tuck fold opening in run 34 of lower belt 20. Segment deflector 94 extends over the downstream'side of roll 72 below each run 13. The deflector 94-includes two bars 96 spaced along the roll axis and overlying the grippers 82 for each lane. Each bar includes a curved circumferential portion 98 spaced outwardly a short distance from the surface of roll 72 and an upper lead in portion 100 angling upwardly and away from the roll to a curved upper end 102 located a short distance below lower belt run 34. Circumferential bar portions 98 extend approximately 90 degrees around roll 72 and include lower ends 104 adjacent stacking and takeaway station 54. Two spaced circumferential grooves 106 are formed in the surface of roll 72 at each lane 13. The grooves 106 extend through clamp members and arms 84 and 86, as illustrated in FIG. 3. Belts 18 surround cutter roll 56 and tucker roll 52. Belts 20 surround rolls 58 and 72 and assembly 54.

Figure 1:
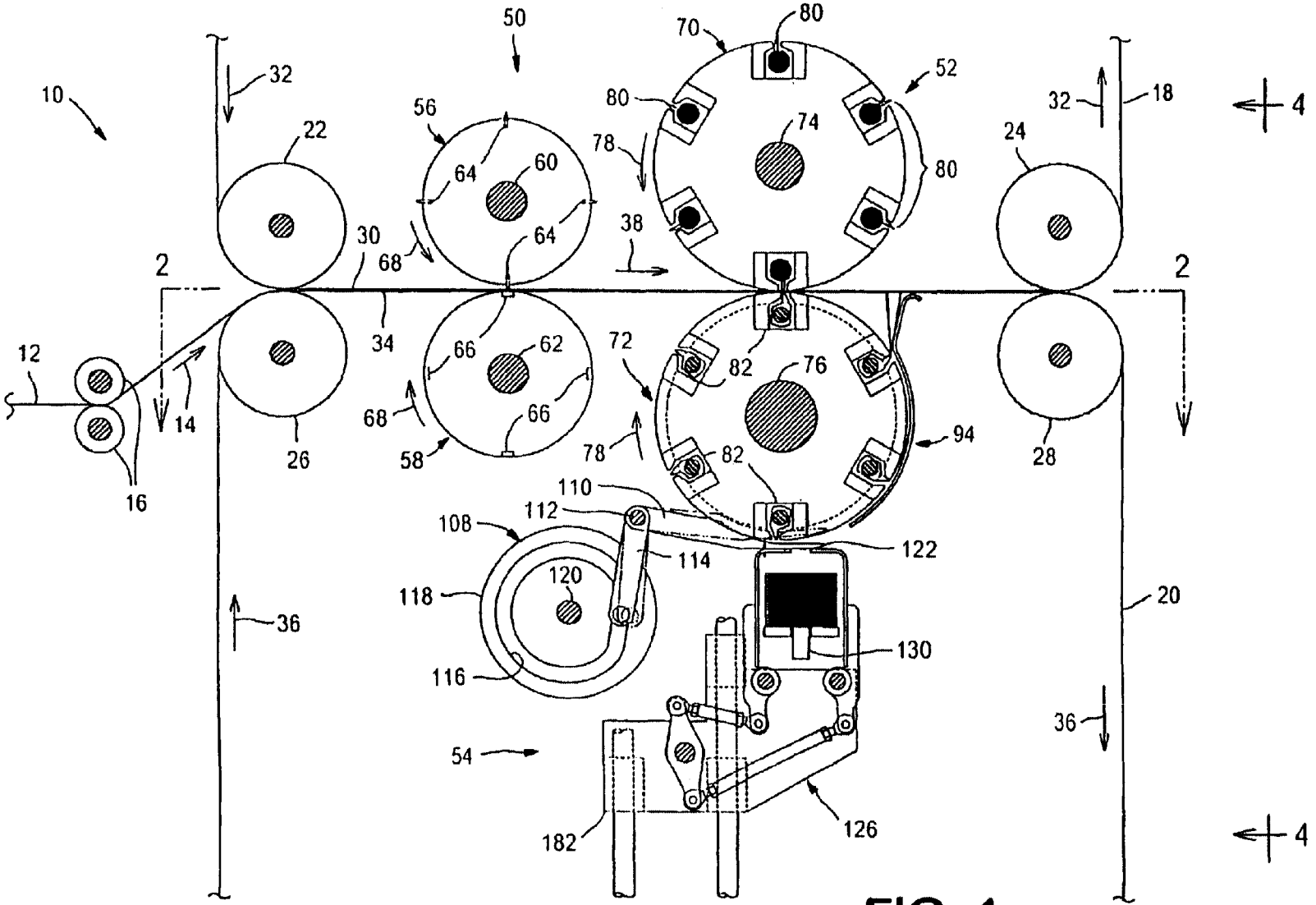
FIG. 1 is a side sectional view of one lane of a cut and tuck folding machine according to the invention.

Stacking and takeaway assembly 54 includes a stripper assembly 108, as shown in FIG. 1. Assembly 108 includes a stripper arm 110 rotatably mounted on shaft 112 supported on the frame of machine 10. The arm 110 includes a lateral arm extension 114 that carries a cam follower roller fitted in groove 116 of rotary cam 118. Cam 118 is mounted on shaft 120 supported on the machine frame and rotated by a drive motor (not illustrated). A number of spaced stripper fingers 122 are formed in the end of arm 110 away from shaft 112. A stripper finger 122 is located in alignment with each stripper groove 106 in roll 72. Rotation of cam 118 rocks arm 110 back and forth to move the stripper fingers between upper positions recessed in grooves 106 and lower positions located below roll 72, as illustrated in FIG. 3. Vertically extending alignment comb 124 is mounted on the machine frame below roll 72 and includes upwardly extending tines between the spaced fingers 122. When lowered, the fingers extend between adjacent tines.

Figure 4:
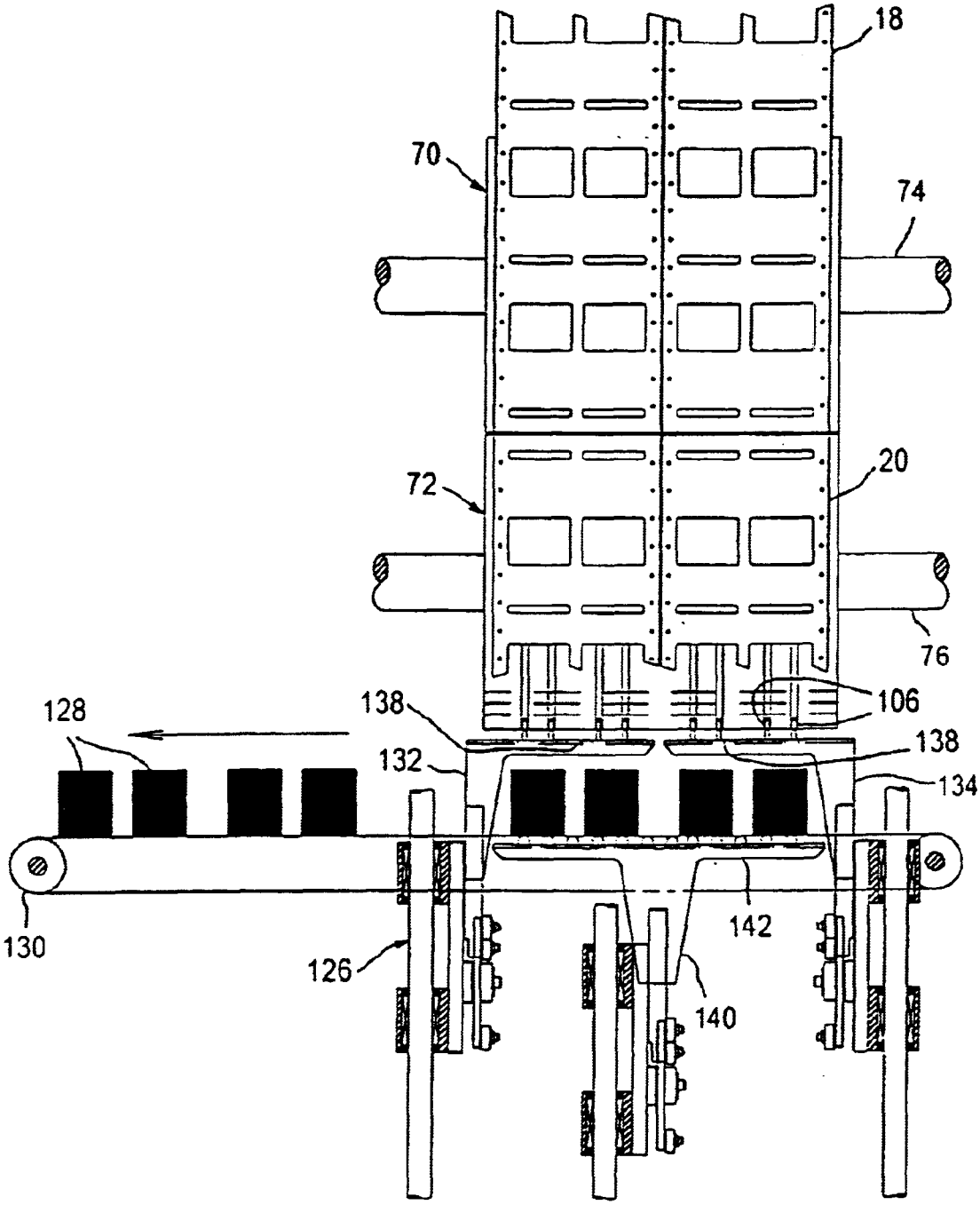
FIG. 4 is an end view of the machine of FIG. 1 taken along line 4—4 of FIG. 1.

Assembly 54 also includes a stacking device 126 for receiving folded web segments stripped from roll 72 and collecting the segments in stacks 128 and delivering the stacks to take away conveyor 130. As illustrated in FIG. 4, the stacking device 126 receives folded web segments cut from all four webs 12 and simultaneously stacks the segments to form four stacks 128 located beneath roll 72. Rolls 24 and 28 and their respective support shafts are not shown in FIG. 4.

The stacking device 126 is located under roller 72 in position to receive individual folded web segments 92 from the roll and collect the segments in a stack having a desired number or count of segments. The stacking device includes a pair of stacking arms 132 below one end of roll 72 and a pair of stacking arms 134 below the other end of roll 72. Conveyor 130 extends between arms 132 and between arms 134. Each arm 132 includes a flat stack support 136 extending under the left portion of roll 74 as shown in FIG. 4 to support folded segments cut from the bottom two lanes 13 shown in FIG. 1. Likewise, each arm 134 includes a flat stack support surface 138 extending under the right portions of roll 74 to support folded segments cut from the upper two lanes 13 shown in FIG. 1.

Device 126 also includes a pair of central stack support arms 140 located on either side of the takeaway conveyor and between arms 132 and 134. Arms 140 each include a single long stack support surface 142 to support stacks of folded web segments cut from all four lanes 13. The stacking device 126 includes a drive (not fully illustrated) which moves arms 132 and 134 and arms 140 through repetitive cycles to receive and stack folded web segments 92.

During stacking, the support surfaces of either arms 132 and 134 or arms 140 are retracted under roll 72 to receive individual folded web segments which are stripped from the roll and then fall down onto the support surfaces. In FIG. 3, arms 140 are shown in the retracted position so that support surfaces 142 support individual folded web segments 92. As segments are discharged onto the retracted arms 140, the stacking device drive lowers the arms 140 so that the upper surface of the growing stack on the arms is maintained at a fixed short distance under the roll 72 to receive additional web segments. During discharge of web segments on the retracted arms 140 arms 132 and 134 are lowered to either side of the belt of takeaway conveyor 130 to deposit the previously formed four stacks on the conveyor 130 for discharge from the machine. After the stacks have been transferred to the belt the stacking device drive rapidly rotates the pairs of arms 132 and 134 outwardly and then raises arms 132 and 134 above arms 140 to the position shown in FIG. 3 outside of arms 140. After the last web segments have been discharged from roll 72 to complete the stacks on arms 140, the drive rapidly lowers the arms 140 to deposit the stacks on the conveyor and, at the same time, rotates arms 132 and 134 into the retracted position prior to the discharge of the next folded segment 92 from roll 72. In this way, stacks of folded web segments are continuously collected and delivered to the takeaway conveyor.

The drive 182 for moving stack support arms 132, 134 and 140 is related to the stack support drive disclosed in U.S. Pat. No. 5,328,323, the disclosure of which is incorporated herein by reference.

The operation of machine 10 will now be described.

Machine 10 simultaneously cuts web segments from the lead ends of the four webs 12 in lanes 13, cross folds the segments, collects them in stacks to a given count and discharges the stacks, typically for packaging. During operation, the speed at which the webs 12 are fed between the upper run 30 and lower run 34 of feed belts 18 and 20 is determined by feed rolls 16. When the machine 10 is set up as in FIGS. 1–4, rolls 16 deliver webs 12 to belts 18 and 20 at the same speed as the belts so that the webs and upper and lower belt runs 30 and 34 are fed together at the same speed past rolls 22 and 26 and to the cutter 50. At cutter 50 the lead ends of the webs are cut by cutter blades 64 extending through the cut openings 44 in both feed belts and against anvils 66 in roll 58 to form web segments 150. Segments 150 extend between adjacent cut openings 44 in the feed belts, are captured between the feed belt runs 30 and 34 and are moved downstream with the belts. As shown in FIG. 2, each segment 150 extends across a tuck fold opening 46 in each of the belt runs located above and below the segments.

The segments 150 are fed downstream until the lead end of the segments passes between rolls 70 and 72 and the tuck fold openings 46 to either side of the segments are located between the rolls. As the segments approach this position one longitudinal row of tuck blades 80 is rotated down into the openings to fold the center of each segment 150 down below lower run 34 and into a space between an open clamp arm 86 and clamp member 84 on roll 72. The moveable arms clamp the folded portions of the web segments against members 84 and, with further rotation, the tuck blades 80 are withdrawn above belt runs 30 and 34 leaving segments 150 clamped in grippers 82. Rotation of roll 72 draws the clamped segments 150 down through the tuck fold openings 46 in run 34 of belt 20 as shown in FIG. 4 to form folded web segments 92 with 180 degree U-folds 152 held in grippers 82 and two equal length legs 154 extending away from the U-fold. Continued rotation of roll 72 moves the U-folded segment under deflector bars 96 and brings legs 154 against deflector lead in 100 to guide the legs into the circumferential space between roll 72 and circumferential portions 98. Legs 154 overlie each other.

When the gripper 82 is rotated to the bottom of roll 72 clamp finger 86 is released and cam 118 rotates stripping fingers 110 from the retracted dotted line positions of FIG. 3 to the solid line positions to strip the released folded web segments from roll 72 and place the segments on the support surfaces or the tops of the partially formed stacks supported below the roll. Comb 124 prevents forward movement of the released folded segment past the support surface or stack. Stripping arm 110 is promptly retracted to be in position to strip the next folded segment from roll 72.

Machine 10 rapidly cuts, folds and stacks web segments and can cut, fold and stack as many as 600 segments from each web per minute. These segments may be formed into stacks or piles having a desired number or count of segments per pile. During cutting, folding and stacking the webs and each segment are positively held in place to reduce the possibility of jams.

Figure 5:
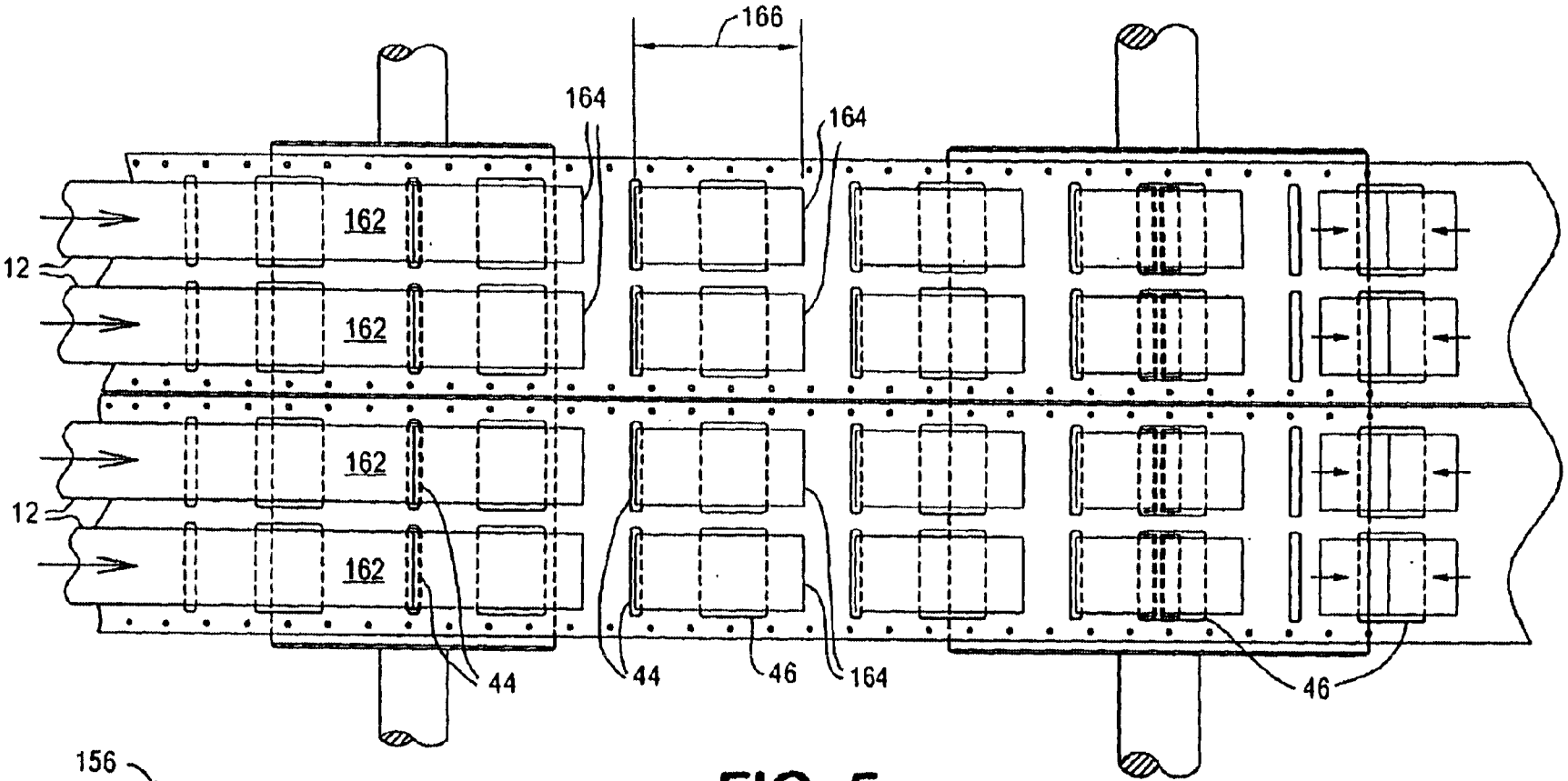
FIG. 5 is a view like FIG. 2 with the machine adjusted to cut and fold shorter web segments.
Figure 5A:
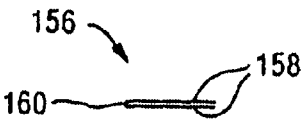
FIG. 5A is a side view of web segment folded per FIG. 5.

Folded web segments 92 have a maximum length, spacing 48 between adjacent cut openings 44. Machine 10 may be adjusted to cut, fold and stack shorter U-folded web segments 156 having equal length legs 158, shorter than legs 154, and a 180 degree U-fold 160, illustrated in FIG. 5A. In this case, illustrated in FIG. 5, the webs 12 are fed by feed rolls 16 between the overlying runs 30 and 34 of belts 18 and 20 at a speed slower than the speed the belts move downstream. The belts move downstream past the retarded webs. The lead ends of the webs are severed to form the web segments 164 having a length 166, less than the spacing between adjacent cut openings 44. See FIG. 5. When segments 164 are severed from the webs frictional engagement with the overlying and underlying belt runs 30 and 34 moves the segments downstream with the belts away from the ends of the retarded webs. The upstream ends of segments 164 are located at the upstream cut openings 44 and the downstream ends of segments 164 are spaced a distance from the downstream cut openings 44. Segments 164 have a length 166 less than length 48 of segments 150. Short segments 164 extend across tuck fold openings 146 in both belt runs 30 and 34.

Continued downstream movement of the belt runs brings the shortened web segments to tuck folder 52 and between rolls 70 and 72. The rotation of rolls 70 and 72 is adjusted so that tuck blades 80 tuck the centers of the shortened segments into grippers 82. The segments are drawn through the tuck fold openings in lower run 34, between deflectors 94 and the roll and to the bottom of the roll where the folded segments are stacked and the stacks are collected on takeaway conveyor 130 as previously described.

Figure 6:
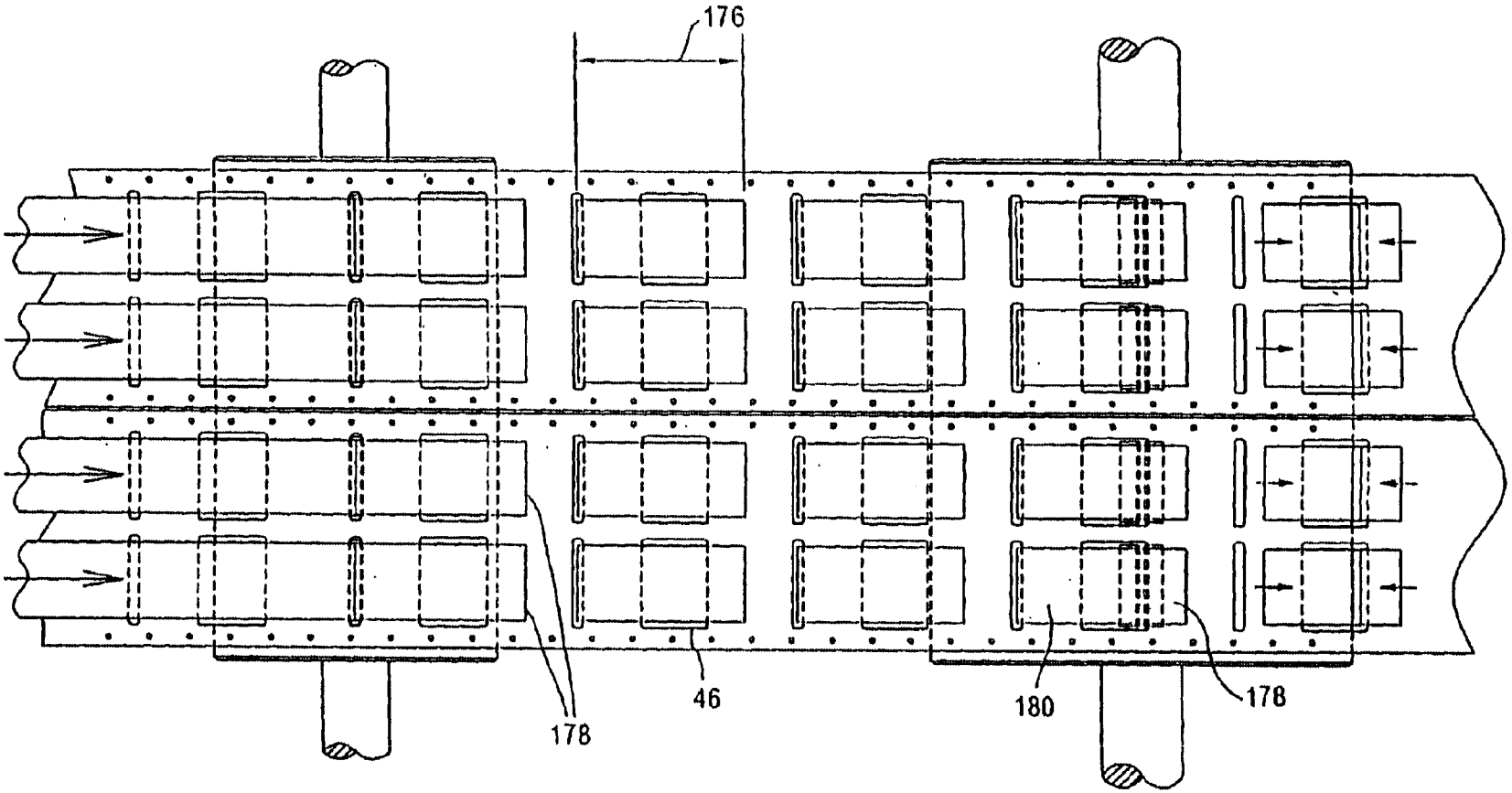
FIG. 6 is a view like FIG. 2 with the machine adjusted to cut short segments and fold the segments with unequal legs.
Figure 6A:
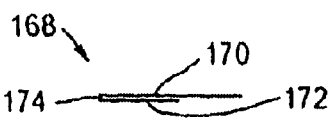
FIG. 6A is a side view of a segment folded by the machine of FIG. 6.

Machine 10 may also be used to form stacks of folded web segments 168 having unequal length legs 170 and 172 joined by 180 degree U-fold 174, as shown in FIG. 6A. FIG. 6 illustrates machine 10 set up to fold segments 168 having a cut length 176 less than maximum cut length 48. In this case, the web feed rolls again feed webs 12 between runs 30 and 34 at a speed slower than belt speed so that the cut station severs short web segments 178 from the ends of the webs. Segments 178 extend past the tuck fold openings 46 in both belt runs. The severed portions 178 are moved downstream with the belts away from the lead web ends to tuck fold station 52. Tuck blades 80 tuck portions of the segments adjacent the lead or downstream ends of the segments into grippers 82 between a short downstream extending segment leg 178 and a longer upstream extending segment leg 180. The gripped segments are withdrawn through the tuck fold openings 46 in lower belt run 34 and folded, stripped and stacked as previously described. In the resultant folded segments 168, long legs 180 form long legs 170 and short legs 178 forms short legs 172.

If desired, machine 10 may be adjusted to cut, fold and stack segments having a maximum length 48 and unequal length legs. This is done by timing the rotation of the rolls in tuck fold station 52 so that tuck blades 80 engage the cut segments a distance to one side of the center of the cut segments.

Disclosed tuck fold openings 46 are wider than webs 12 and have a downstream edge sufficiently to one side of the center between adjacent cut openings to permit tuck folding at the center of short or long segments. The tuck fold openings extend upstream a distance sufficient to permit center tuck folding of shortened segments and off center folding of full length and shortened segments, as desired. The tuck fold openings could extend downstream from the center position between cut openings to permit folding of segments with short upper legs and long lower legs, if desired.

The feed speed of web feed rollers 16 and the circumferential positions of tuck station rolls 70 and 72 are adjusted as required to permit machine 10 to stack folded segments as described. These adjustments are easily and rapidly accomplished through conventional drive controls.

Disclosed apparatus 10 includes a tuck folder with a tuck roll on one side of the two belt runs and a gripper roll on the other side of the runs with tucker blades carried by the tucker roll and grippers carried by the gripper rolls. The invention is not limited to tuck folders with tuck and gripper rolls. Other types of tuck folders may be used to move a central portion of a cut web segment through a tuck opening for engagement by a gripper and withdrawal from between the webs. For instance, tucker blades could be mounted on a conveyer having a run extending parallel to one side of the two belts with a device to extend the blades into tuck openings to push segments outwardly of the belts to be engaged by a gripper as described. The gripper need not be mounted on a gripper roll. The gripper could be mounted on a belt movable along the runs.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. Apparatus for cutting and tuck folding web material, the apparatus including a first endless feed belt having a first run; a second endless feed belt having a second run, said belt runs overlying each other; belt drive means for moving the belt runs downstream together at a belt speed; each belt including a plurality of first cut openings extending through the belt and spaced along the belt and a plurality of first tuck fold openings extending through the belt and spaced along the belt, each tuck fold opening located between two adjacent cut openings, the cut openings in each belt and the tuck fold openings in each belt overlying each other at said runs; a first web cutter; a first tuck folder; said belt runs extending past said cutter and folder with said cutter located upstream of said folder; the cutter including a first cut member on one side of said runs and a second cut member on the other side of said runs, said members cooperable to cut a segment from the lead end of a web fed between said runs through overlying cut openings; said tuck folder including a tuck blade on one side of said runs and a gripper on the other side of said runs; and tuck folder drive means for moving the tuck blade and the gripper downstream along said runs and extending the tuck blade through overlying tuck openings to move web segments held between said runs at the tuck openings into the gripper for clamping by the gripper so that the gripper pulls gripped web segments from between said belt runs and through the tuck fold openings and folds the segments.

2. Apparatus as in claim 1 wherein the first cut member comprises a first roll on one side of the runs and includes a plurality of first cutter elements spaced around the first roll, and the second cut member comprises a second roll on the other side of said runs and includes a plurality of second cut elements spaced around the second roll.

3. Apparatus as in claim 2 wherein said first elements comprise cutter blades and said second elements comprise anvils.

4. Apparatus as in claim 1 wherein each said belt is formed from a band of flexible stainless steel.

5. Apparatus as in claim 1 wherein said first belt surrounds first portions of the web cutter and first portions of the tuck folder, and said second belt surrounds second portions of said web cutter and second portions of the tuck folder.

6. Apparatus as in the claim 5 including a web segment stacker located adjacent to said gripper roll.

7. Apparatus as in claim 6 wherein one belt surrounds said web segment stacker.

8. Apparatus as in claim 6 including a stripper for moving folding web segments from the gripper roll to the stacker.

9. Apparatus as in claim 8 wherein the gripper roll includes a stripper groove and the stripper includes a member movable between a retracted position in the groove and an extended position adjacent the stacker.

10. Apparatus as in claim 6 including a web segment deflector overlying the gripper roll and spaced a short distance outwardly from the circumference of the gripper roll wherein the gripper roll carries gripped web segments under the deflector to move the legs of the segments together.

11. Apparatus as in the claim 10 wherein said deflector includes a lead-in portion and an end adjacent to said runs.

12. Apparatus as in claim 11 wherein said deflector comprises two circumferentially extending the bars overlying said gripper roll, each bar extending about 90° around the gripper roll.

13. Apparatus as in claim 6 wherein said stacker is located adjacent an end of the segment deflector away from said runs; and including a stripper for moving folded segments away from the gripper roll and transferring the segments to the stacker.

14. Apparatus as in claim 1 including web feed means located upstream of said runs for feeding a web between said runs at a web speed.

15. Apparatus as in claim 14 wherein said web speed is less than said belt speed so that said belt runs move downstream faster than said web, and severed web segments move downstream with said belt runs away from the end of the web and have a length less than the distance between adjacent cut openings in the belts.

16. Apparatus as in claim 1 wherein said tuck fold openings are wider than said cut openings.

17. Apparatus as in claim 1 wherein each belt includes a plurality of second cut openings and a plurality of second tuck fold openings, said second openings located to one side of said first openings, and the apparatus cuts and tuck folds segments from two webs.

18. Apparatus as in claim 17 wherein said tuck fold openings are wider than said cut openings.

19. Apparatus as in claim 17 wherein said tuck folder includes a roll, a plurality of second tucker blades spaced around the roll, and said gripper includes a roll and a plurality of second grippers spaced around the circumference thereof, said plurality of second tucker blades and said plurality of second grippers aligned with the second plurality of cut openings and the second plurality of tuck fold openings.

20. Apparatus as in claim 1 including a third feed belt having a third run, a fourth feed belt having a fourth run, such third and fourth runs overlying each other and extending parallel to said first and second runs; said drive means moving said third and fourth belt runs downstream together at said belt speed; each third and fourth belt including a plurality of second regularly spaced cut openings extending through the belt and spaced along the belt and a plurality of second regularly spaced tuck fold openings extending through the belt and spaced along the belt, such cut openings and tuck fold openings in such belts overlying each other at such runs; a second web cutter for cutting web segments from a web confined between said second and third belt runs; and a second tuck folder for tuck folding severed web segments from between said second and third runs.

21. Apparatus as in claim 1 wherein said runs are straight.

22. Apparatus for cutting and tuck folding web material from a plurality of webs, the apparatus including a plurality of first endless feed belts each having a first run, a plurality of second endless feed belts each having a second run, the run of each of said first belts overlying the run of one of said second belts; belt drive means for moving the overlying belt runs downstream together at a belt speed; each belt including a plurality of first regularly spaced cut openings extending through the belt and spaced along the belt and a plurality of first regularly spaced tuck fold openings extending through the belt and spaced along the belt, each tuck fold opening located between two adjacent cut openings; the cut openings and the tuck fold openings overlying each other at said runs; a web cutter for severing lead portions of webs held between belt runs; a tuck folder located downstream from the cutter and including a tuck roller on one side of said runs and a gripper roller on the other side of said runs, the tuck folder including a plurality of tucker blades spaced around the circumference thereof to one side of each pair of belt runs, the gripper roller including a plurality of grippers spaced around the circumference thereof adjacent each pair of overlying belt runs, tuck folder drive means the rotating said tuck and gripper rolls to move the tuck blades and grippers downstream along said runs so that the tuck blades extend through tuck openings, move web segments held between such runs at the tuck openings into grippers for clamping and withdrawal of the segments from the runs through tuck fold openings in the belts adjacent the gripper roll.

23. Apparatus as in claim 22 including the plurality of stackers, each stacker located adjacent to a plurality of grippers on the gripper roller to receive folded web segments from such grippers.

24. Apparatus as in claim 23 including the plurality of strippers each located between the gripper roll and a stacker.

25. Apparatus as in claim 24 wherein the gripper roll includes at least one circumferential groove at each plurality of grippers and a stripper moveable into and out of such groove.

26. Apparatus as in claim 22 wherein said first feed belts extend around a first part of the web cutter and a first part of the tuck roller, and said second feed belts extend around a second part of the web cutter, as second part of the gripper roller and the stackers.

27. Apparatus for cutting and tuck folding web material, the apparatus including a first endless feed belt having a first run, a second endless feed belt having a second run, said belt runs overlying each other; belt drive means for moving the belt runs downstream together at a belt speed; each belt including a plurality of cut openings extending through the belt and spaced along the belt and a plurality of tuck fold openings extending through the belt and spaced along the belt, each tuck fold opening located between two adjacent cut openings, the cut openings in each belt and the tuck fold openings in each belt overlying each other at said runs; a web cutter; a tuck folder; said belt runs extending past said cutter and folder with said cutter located upstream of said folder; the cutter including a first cut member on one side of said runs and a second cut member on the other side of said runs, said members cooperable to cut a segment from the lead end of a web fed between said runs through overlying cut openings; said tuck folder including a tucker member on one side of said runs and a gripper on the other side of said runs, and tuck folder drive means to move the tucker member and the gripper so that the tucker member extends through overlying tuck openings, moves a web segment held between said runs at the tuck openings into the gripper for clamping by the gripper and the gripper pulls the gripped web segment from between said belt runs and through the tuck fold opening in the belt adjacent the gripper roll.

28. Apparatus as in claim 27 including web feed means located upstream of said runs for feeding a web between said runs at a web speed.

29. Apparatus as in claim 28 wherein said web speed is less than said belt speed.

30. Apparatus as in claim 27 wherein said tuck folder includes a tuck roll on one side of said runs and a plurality of tuck blades spaced around the tuck roller; and a gripper roll on other side of said runs and a plurality of grippers spaced around the gripper roller.

31. Apparatus as in claim 30 including a stacker for receiving cut and folded web segments from the gripper roller.

32. The method of cutting and tuck folding web material in a device having downstream moving belts with overlying runs comprising the steps of:

a) moving the belts downstream at said runs with said runs overlying each other and each moving at a belt speed;

b) feeding an end of a web into the upstream end of said runs and downstream between said runs at a web speed;

c) severing a web portion from an end of the web and moving the severed web portion downstream with said belts at said belt speed;

d) extending a tucker blade on one side of said runs through said belts to move a part of the web portion outwardly from the other side of said runs; and e) gripping the part of the web segment located outwardly of the other side of the runs and moving said part away from the runs to pull the entire web segment through a belt and out from between the runs.

33. The method of claim 32 including the step of:

f) moving the legs of the web segment together.

34. The method of claim 33 including the step of:

g) placing the folded web segment on a stack.

35. The method of claim 32 including the steps of:

f) feeding the web between said runs at a web speed less than the belt speed and moving said runs past the web; and g) moving the severed web portion away from the end of the web.

36. Apparatus for cutting and tuck folding web material, the apparatus including a first endless feed belt having a first run; a second endless feed belt having a second run, said second run overlying said first run; belt drive means for moving the belt runs downstream; a plurality of openings extending through both belts at said runs, said openings including a plurality of first cut openings extending through the first belt and spaced along the first belt and a plurality of first tuck fold openings extending through the first belt and spaced along the first belt, each tuck fold opening located between two adjacent cut openings; a first web cutter; a first tuck folder; said belt runs extending past said cutter and folder with said cutter located upstream of said folder; the cutter including a first cut member on one side of said runs and a second cut member on the other side of said runs, said members cooperable to cut a segment from the lead end of a web fed downstream between said belts at said runs at each cut opening; said tuck folder including a tucker blade on one side of said runs and a gripper on the other side of said runs; tucker blade drive means for extending the tucker blade through tuck openings and moving web segments held between said belts at the tuck openings away from the belts and into the gripper; and gripper drive means for moving the gripper away from the belts to pull the web segments from between the belts through tuck fold openings and fold the web segments.

37. Apparatus as in claim 36 wherein said second belt includes a plurality of first cut openings extending through the belt and spaced along the belt and a plurality of first tuck fold openings extending through the belt and spaced along the belt, each such tuck fold opening located between two adjacent such cut openings.

38. Apparatus as in claim 36 wherein said belt drive moves said belts downstream at a belt speed; and said web speed is less than said belt speed.

39. Apparatus as in claim 36 wherein the first cut member comprises a cutter roll and a blade on such roll; the second cut member comprises an anvil roll and an anvil on such roll; the tuck folder comprises a tucker blade roll on one side of the runs and a gripper roll on the other side of the runs, said tucker blade on said tucker blade roll and said gripper on said gripper roll; and rotary drive means for rotating said rolls downstream along the runs.

40. Apparatus as in claim 39 including a folded segment stacker located adjacent the gripper roll; and a stripper for moving folded segments from the gripper roll to the stacker.

41. Apparatus as in claim 39 including a web segment deflector overlying the gripper roll and spaced a short distance outwardly from the gripper roll, wherein the gripper roll carries gripped web segments under the deflector to move the legs of the segments together.

42. Apparatus as in claim 36 wherein each belt is formed from a metal band.

43. Apparatus as in claim 36 wherein each belt surrounds part of the web cutter and part of the tuck folder.

44. Apparatus as in claim 36 including web feed means located upstream of said runs for feeding a web between said runs at a web speed.

45. Apparatus as in claim 44 including a segment take away conveyor, one belt surrounding said conveyor.

46. The method of cutting and tuck folding web material in a device having downstream moving belts with overlying runs, comprising the steps of:

a) moving the belts downstream at said runs with said runs overlying each other and each belt moving at a belt speed;

b) feeding an end of a web into the upstream end of said runs and downstream between said runs at a web speed;

c) severing a web portion from an end of the web and moving the severed web portion downstream with said belts at said belt speed;

d) extending a tucker blade on one side of said runs through said belts to move a part of the web portion outwardly from the other side of said runs; and e) gripping the part of the web segment located outwardly of the other side of the runs and moving said part away from the runs to pull the web segment through a belt and away from between the runs and fold the web segment.

47. The method of claim 46 including the steps of:

f) feeding the web between said runs at a web speed less than the belt speed, moving said runs past the web; and g) moving the severed web portion away from the end of the web at belt speed.

* * * * *